United States Patent [19]

Hogan, II

[11] 4,101,292

[45] Jul. 18, 1978

[54] CHARCOAL BRIQUETTE PACKAGING TECHNIQUE

[76] Inventor: Robert Paul Hogan, II, P.O. Box 18285, Corpus Christi, Tex. 78418

[21] Appl. No.: 823,454

[22] Filed: Aug. 10, 1977

[51] Int. Cl.[2] ..... C10L 11/00; B65D 65/00

[52] U.S. Cl. ..... 44/40; 44/41; 206/497

[58] Field of Search ..... 44/38, 40, 41; 206/497

[56] References Cited

U.S. PATENT DOCUMENTS

| | | | |
|---|---|---|---|
| 2,071,300 | 2/1937 | Gammeter | 206/497 X |
| 2,799,563 | 7/1957 | Shenker | 44/40 |
| 3,026,656 | 3/1962 | Rumsey, Jr. | 206/497 X |
| 3,351,443 | 11/1967 | Gramm et al. | 44/40 |
| 3,846,086 | 11/1974 | Balch et al. | 44/40 |

FOREIGN PATENT DOCUMENTS

| | | | |
|---|---|---|---|
| 508,053 | 6/1939 | United Kingdom | 44/40 |

*Primary Examiner*—Carl F. Dees
*Attorney, Agent, or Firm*—G. Turner Moller

[57] ABSTRACT

There is disclosed a technique for packaging charcoal briquettes which may or may not be impregnated with a flammable liquid. The briquettes are placed in an impermeable plastic bag which is filled with an inert gas atmosphere and then collapsed closely about the briquettes. The bag is sealed and then wrapped in a paper covering impregnated with a flammable liquid. The partially completed unit is then placed and sealed in a second gas impermeable plastic bag. One or more of such unit handled masses are then placed in a conventional paper sack for delivery through ordinary channels of commerce.

11 Claims, 5 Drawing Figures

CHARCOAL BRIQUETTE PACKAGING TECHNIQUE

This invention relates to a technique for packaging charcoal briquettes and particularly to a technique for packing charcoal briquettes which are associated with a flammable liquid which can readily be ignited to provide a readily ignitable charcoal briquette bed.

It is well known in the prior art to impregnate charcoal briquettes with a flammable liquid as shown in the U.S. patent Nos. 2,799,563 and 3,846,086.

One difficulty with impregnated charcoal briquettes of the prior art is that the flammable liquid tends to evaporate in storage thereby creating a variety of substantial problems. First, evaporation of the flammable liquid normally causes a substantial odor problem in storage. Second, a fire hazard is created because of the impregnant vapors. Third, the ability of the flammable impregnant to ignite the charcoal briquettes is reduced in accordance with the amount of evaporation that has occurred.

The present invention overcomes the foregoing and other disadvantages of the prior art and provides a relatively inexpensive technique for packaging charcoal briquettes associated with a flammable liquid which is intended to provide means for igniting the charcoal briquettes.

In accordance with one embodiment of the invention, the charcoal briquettes are impregnated with a flammable liquid and then relatively closely packed in a gas impermeable plastic bag. Oxygen containing atmosphere in the plastic bag is substantially replaced by an inert gas atmosphere. A partial vacuum is then drawn in the plastic bag and the bag is sealed to provide a unit handled mass in which the charcoal briquettes are relatively closely packed and supported by the collapsed plastic bag.

The plastic bag is then placed in a paper sack impregnated with a flammable liquid. This unit is then placed in a second gas impermeable plastic bag which is evacuated and sealed. One or more of such units are then placed in an ordinary paper sack and delivered through ordinary channels of commerce to the consumer.

The function of the first or inner plastic bag is to prevent evaporation of the liquid impregnant from the charcoal briquettes thereby obviating the disadvantages resulting therefrom. The impregnated paper covering surrounding the first plastic bag is provided as a means for readily igniting the liquid impregnant in the charcoal briquettes. The second or outer plastic bag acts to prevent evaporation of the liquid impregnant from the impregnated paper covering. The second plastic bag acts to prevent evaporation of the liquid impregnant from the paper covering thereby obviating disadvantages accruing therefrom.

In use, assuming that a plurality of the unit handled masses are shipped in a common paper sack, the consumer opens the paper sack, removes one or more of the unit handled masses and juxtaposes an open flame to the second or outer plastic bag. The second plastic bag either melts or ignites thereby exposing the impregnated paper covering which also ignites. The paper covering acts to ignite or melt the inner and outer plastic bags and ignites the impregnant in the charcoal briquettes. The briquettes thereby ignite. Upon the destruction of the inner and outer plastic bags, the charcoal briquettes are freed from constraint and tend to settle into a single layer of ignited briquettes. It will accordingly be apparent that this technique provides a simple, clean and expeditious means of providing a self-ignitable charcoal briquette bed.

In accordance with another embodiment of the invention, unimpregnated charcoal briquettes are placed in a first or inner gas impermeable plastic bag which is then sealed. A paper covering is wrapped about the first plastic bag and impregnated with a flammable liquid. The partially completed unit is then placed in a second gas impermeable plastic bag which is then evacuated and sealed. The resultant unit handled mass is then packaged singly or in multiples in a conventional paper sack and delivered through ordinary channels of commerce to the consumer.

In this embodiment of the invention, the impregnated paper covering acts to ignite or melt the inner and outer plastic bags and to ignite the charcoal briquettes.

As will be apparent from the foregoing summary, it is a general object of this invention to provide a new and improved technique for packaging charcoal briquettes and to provide a new and improved charcoal briquette package.

Other objects and a fuller understanding of the invention may be had by referring to the following description and claims taken in conjunction with the accompanying drawing.

Figure 1:
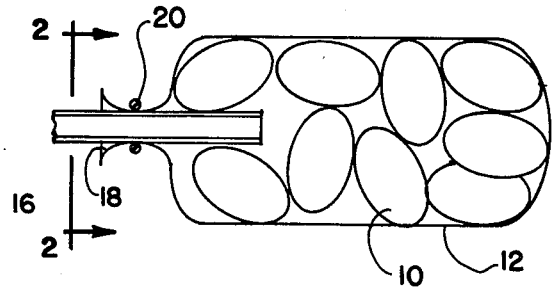
FIG. 1 is a plan view of a multiplicity of charcoal briquettes in a plastic bag in the process of replacing an oxygen containing atmosphere with an inert gas atmosphere and evacuating the plastic bag.
Figure 2:
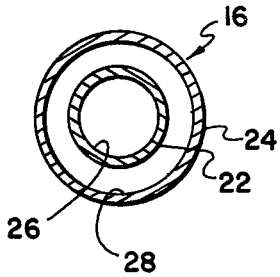
FIG. 2 is an enlarged cross-sectional view of the gas exchanging mechanism of FIG. 1 taken substantially along line 2—2 thereof as viewed in the direction indicated by the arrows.

Referring to FIG. 1, there is illustrated a multiplicity of charcoal briquettes 10 loosely packed in a gas impermeable plastic bag 12. The charcoal briquettes 10 are of conventional type and are preferably but not essentially impregnated with a flammable liquid as has been suggested in the prior art. The nature of the flammable liquid may vary widely depending on cost and current governmental regulations, particularly regarding flash point and the like. One exemplary impregnant is a petroleum distillate having a minimum flash point of 168° F, which is basically kerosene. This distillate, in an amount of 5–50% by weight, is applied to the charcoal briquettes in any suitable fashion, as by dipping or spraying. Other suitable flammable liquid hydrocarbons may likewise be used such as ethylene glycol monobutyl ether, ethylene glycol dibutyl ether, ethylene glycol diformate, ethylene glycol monoacetate, ethylene glycol monobenzyl ether, ethylene glycol monobutyl ether acetate and the like. A suitable quantity of such materials is applied to the charcoal briquettes to assure ignition thereof. In addition, 1–3% by weight of mesquite essence or hickory essence may also be applied to the charcoal briquette 10.

Figure 5:
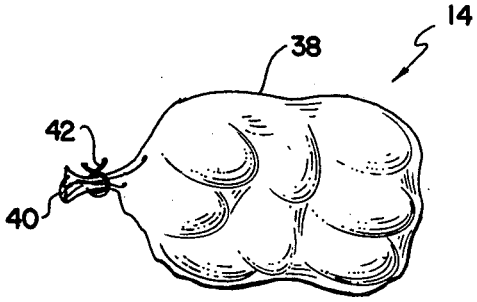
FIG. 5 is a plan view of a completed unit handled mass of charcoal briquettes which is ready to be packaged in a conventional paper sack.

The plastic bag 12 is gas impermeable to prevent impregnant vapors from escaping through the bag thereby controlling the impregnant vapor pressure in the bag and consequently controlling the extend of impregnant evaporation. The bag 12 is typically an organic polymeric material such as polyethylene, polyvinyl chloride, polypropylene, polyethylene terephthalate, copolymers thereof, and the like of suitable thickness to provide sufficient mechanical strength to constrain the charcoal briquettes 10 and to withstand normal mechanical abuse during packaging of the unit handled mass 14 illustrated in FIG. 5 and during transit thereof. A polyethylene bag having a 2 mil thickness has proved quite satisfactory.

After the briquettes 10 have been placed in the bag 12, a conduit 16 is inserted into the open bag end 18 and a temporary seal is provided between the bag 12 and the conduit 16 as by the use of a removable clamp 20.

The conduit 16 comprises inner and outer tubes 22, 24 providing an inner passageway 26 and an annular passage 28 from the exterior into the interior of the bag 12. The conduit 16 is used to replace the oxygen containing atmosphere in the bag 12 with an inert or substantially non-reactive gas atmosphere, such as carbon dioxide, nitrogen, any of the inert gaseous elements, and mixtures thereof. To this end, the central passage 26, for example, is connected to a vacuum source (not shown) and the annular passageway 28 is connected to a source (not shown) of the inert or substantially unreactive gas material. The vacuum source is energized to evacuate the bag 12 to a substantial degree, typically in the range of 5–15 inches Hg and preferably about 10 inches Hg. The vacuum source is then turned off and the inert gas source is energized to fill the bag 12 with the inert gas at substantially atmospheric pressure. In the alternative, the vacuum source may be left on while injecting inert gas into the bag 12 to further flush the oxygen containing atmosphere therefrom. The inert gas source is then turned off and the vacuum source reenergized to substantially evacuate the bag 12 to a vacuum in the range of 2–15 inches Hg and a preferably about 5 inches Hg.

Figure 3:
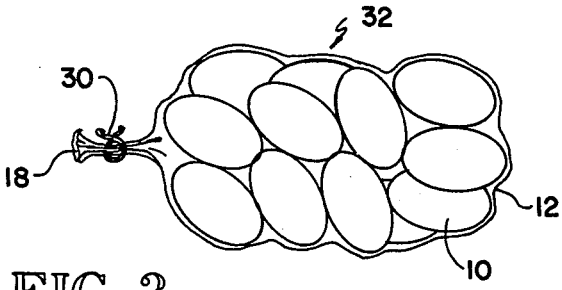
FIG. 3 is a plan view of the evacuated plastic bag having therein the multiplicity of charcoal briquettes.

The bag 12 accordingly collapses about the charcoal briquettes 10 and acts to further compact the briquettes 10 as illustrated in FIG. 3. The conduit 16 is then removed from the bag 12 and the end 18 thereof sealed in any conventional fashion, as by heat sealing or by applying an adhesive inside the end 18 and affixing a clamp 30 thereon to provide a partially completed unit 32. It will be apparent that the plastic bag acts to minimize odors or vapor contamination in storage areas, maintains the ability of the liquid impregnant to ignite the charcoal briquettes 10, and minimizes fire hazards due to impregnant vapors. In addition, the presence of an inert gas atmosphere in the bag 12 substantially prevents spontaneous combustion of the briquettes 10 until the barrier afforded by the bag 12 is breached. The collapse of the plastic bag 12 is sufficient to compact the briquettes 10 into an unbendable packing, i.e. no relatively straight line in any direction across the partially completed unit 32 exists which does not intersect one of the briquettes 10. Indeed, the bag 12 is sufficiently tight that the briquettes do not rattle upon shaking of the unit 32.

Rather than collapsing the plastic bag 12 by drawing a vacuum in the conduit 16, the material of the plastic bag 12 may be selected from one of a group of heat shrinkable films. After the bag 12 has been filled with the briquettes 10 and the oxygen containing atmosphere has been exchanged with an inert gas atmosphere at substantially atmospheric pressure, the bag 12 is heat shrunk in any suitable manner, as by passing the bag 12 through a suitable oven, exposing the bag 12 to a stream of steam or hot air, or by immersing part of the bag in a hot liquid bath. The bag 12 is accordingly collapsed about the charcoal briquettes 10. The bag 12 is then sealed in any suitable fashion to provide the partially completed unit 32 of FIG. 3.

Figure 4:
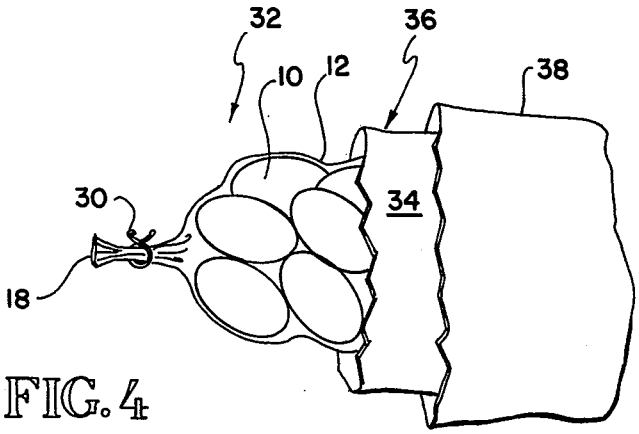
FIG. 4 is a broken view illustrating the plastic bag of FIG. 1 inside a fiber covering which is, in turn, inside a second plastic bag.

Referring to FIG. 4, the partially completed unit 32 is wrapped or juxtaposed to an impregnated fiber covering 34 which is conveniently an impregnated paper sack. The paper sack 34 is wrapped tightly about the partially completed unit 32 and may be impregnated either before wrapping or after wrapping. The impregnant used on the paper sack 34 may be any of the flammable liquid impregnants previously mentioned.

After the partially completed unit 32 has been enclosed by the impregnated paper sack 34, to provide a more nearly completed unit 36, the unit 36 is placed in a second or outer gas impermeable plastic bag 38. The outer plastic bag 38 may be of any suitable type material such as previously mentioned with regard to the bag 12. In addition, the oxygen containing atmosphere in the bag 38 may be exchanged with an inert or substantially non-reactive gas in a manner similar to the bag 12. The outer plastic bag 38 is then collapsed about the unit 36 either by drawing a vacuum therein or by heat shrinking the bag 38. The open end 40 of the bag 38 is then closed and sealed in any suitable fashion, as by heat sealing or by adhesively closing the same and using a clamp 42 thereon.

One or more of the unit handled masses 14 are then placed in a conventional paper sack and delivered through normal channels of commerce. When packed in multiples, the unit handled masses 14 conveniently include about 1 pound dry weight charcoal briquettes.

If the consumer desires to ignite all of the briquettes 10 in the shipping packing, the shipping packing is placed in the barbeque pit and an open flame is juxtaposed to the shipping sack. The shipping sack accordingly ignites and either melts or ignites the outer plastic bag 38 thereby exposing the impregnated paper covering 34 which in turn ignites. The paper covering 34 acts to ignite or melt the inner plastic bag 12 and assures the ignition or melting of the outer plastic bag 38. In addition, the paper covering 34 ignites the impregnant in the charcoal briquettes 10 thereby igniting the briquettes. Upon the destruction of the shipping sack, the outer plastic bag 38, the paper covering 34 and the inner plastic bag 12, the charcoal briquettes 10 are freed from constraint and tend to settle in a single layer of ignited briquettes 10. It is accordingly apparent that this invention provides a simple, clean and expeditious means of providing a self-ignitable charcoal briquette bed.

In the event the unit handled masses 14 are packaged in multiples in a shipping sack and the consumer desires to ignite less than all of the unit handled masses 14, one or more of the masses 14 are removed from the shipping sack, placed in the barbeque pit and an open flame is juxtaposed to the outer plastic sack 38. The outer plastic sack 38 accordingly melts or ignites thereby setting off the chain of ignition previously described.

In the event that the charcoal briquettes are not impregnated with a flammable liquid impregnant, the impregnant in the paper covering 34 is designed to provide a sufficient hot flame to ignite the unimpregnated charcoal briquettes. In this embodiment of the invention, the function of the inner plastic bag 12 is slightly changed. Rather than preventing evaporation of the impregnant from the briquettes 10, the bag 12 acts mechanically to constrain the briquettes 10 in a unit handled package allowing convenient wrapping of the partially completed unit 32 by the paper covering 34. In addition, the plastic bag 12 prevents adsorption of the impregnant in the paper covering 34 into the briquettes 10.

Although the invention has been described in its preferred forms with a certain degree of particularity, it is understood that the present disclosure of the preferred embodiments has been made only by way of example and numerous changes in the details of construction and the combination and arrangement of parts may be restored to within the spirit and scope of the invention as hereinafter claimed. It is intended that the patent shall cover, by suitable expression in the appended claims, whatever features of patentable novelty exist in the invention disclosed.

I claim:

1. A charcoal briquette packaging comprising a sealed gas impermeable organic polymeric inner bag having therein a multiplicity of abutted charcoal briquettes, the bag being collapsed about the briquettes to provide a compact unbendable unit having a substantially reduced gas volume therein;

a fiber covering, juxtaposed to the inner bag, impregnated with a flammable liquid; and a sealed gas impermeable organic polymeric outer bag surrounding the fiber covering.

2. The package of claim 1 wherein the briquettes are impregnated with a flammable liquid.

3. The package of claim 1 wherein the inner plastic bag has been shrunk to closely conform to the charcoal briquette exteriors.

4. The package of claim 1 wherein the gaseous pressure in the inner bag is less than atmospheric.

5. The package of claim 4 wherein the inner bag contains a substantially inert atmosphere.

6. A charcoal briquette package, comprising a multiplicity of abutted charcoal briquettes;

a fiber covering, enclosing the briquettes, impregnated with a flammable liquid; and a sealed gas impermeable organic polymeric bag surrounding the fiber covering.

7. The package of claim 6 wherein the briquettes are impregnated with a flammable liquid.

8. The package of claim 6 further comprising another sealed gas impermeable organic polymeric bag surrounding and in intimate contact with the charcoal briquettes, the fiber covering being in intimate contact with the outer bag.

9. A method of packaging charcoal briquettes, comprising placing a multiplicity of charcoal briquettes in a gas impermeable organic polymeric first bag;

steps for replacing the oxygen containing atmosphere in the first bag with an inert gas atmosphere and collapsing the first bag;

sealing the first bag;

juxtaposing a fiber material in intimate contact with the first bag;

impregnating the fiber material with a flammable liquid; and steps for sealing the fiber material, first bag and briquettes in a partially evacuated gas impermeable organic polymeric second bag.

10. The method of claim 9 further comprising the step of impregnating the charcoal briquettes with a flammable liquid prior to placing the briquettes in the first bag.

11. The method of claim 9 wherein the juxtaposing step comprises enclosing the first bag with the fiber material.

* * * * *